US007655126B2

(12) United States Patent
Luo

(10) Patent No.: US 7,655,126 B2
(45) Date of Patent: Feb. 2, 2010

(54) FABRICATION OF TOPICAL STOPPER ON MLS GASKET BY ACTIVE MATRIX ELECTROCHEMICAL DEPOSITION

(75) Inventor: Yuefeng Luo, Ann Arbor, MI (US)

(73) Assignee: Federal Mogul World Wide, Inc., Southfield, MI (US)

( * ) Notice: Subject to any disclaimer, the term of this patent is extended or adjusted under 35 U.S.C. 154(b) by 704 days.

(21) Appl. No.: 11/277,544

(22) Filed: Mar. 27, 2006

(65) Prior Publication Data

US 2007/0221504 A1 Sep. 27, 2007

(51) Int. Cl.
*C25D 5/02* (2006.01)

(52) U.S. Cl. ..... 205/136; 205/118; 204/224 R; 204/280

(58) Field of Classification Search ..... 205/118, 205/122, 135, 136; 204/224 R, 280
See application file for complete search history.

(56) References Cited

U.S. PATENT DOCUMENTS 4,119,516 A * 10/1978 Yamaguchi ..... 204/224 R
4,560,460 A 12/1985 Blasing et al.
5,049,246 A 9/1991 Hull et al.
5,242,562 A 9/1993 Beyerle et al.
5,322,299 A 6/1994 Terai
5,395,508 A * 3/1995 Jolly et al. ..... 205/129
5,641,391 A 6/1997 Hunter et al.
5,908,544 A 6/1999 Lee et al.
6,168,703 B1 1/2001 Lee et al.
6,197,181 B1 3/2001 Chen
6,228,231 B1 5/2001 Uzoh
6,261,433 B1 * 7/2001 Landau ..... 205/96
6,277,263 B1 8/2001 Chen
6,391,166 B1 5/2002 Wang
6,402,923 B1 6/2002 Mayer et al.
6,475,369 B1 11/2002 Cohen
6,551,484 B2 * 4/2003 Hey et al. ..... 205/96
6,565,729 B2 5/2003 Chen et al.
6,660,137 B2 12/2003 Wilson et al.
6,755,954 B2 6/2004 Mayer et al.
6,758,951 B2 7/2004 Giaquinta et al.
7,160,421 B2 * 1/2007 Wilson et al. ..... 204/229.4
2002/0098332 A1 7/2002 Warren et al.
2002/0125141 A1 9/2002 Wilson et al.
2002/0139678 A1 10/2002 Wilson et al.

(Continued)

*Primary Examiner*—Nam X Nguyen
*Assistant Examiner*—Luan V Van
(74) *Attorney, Agent, or Firm*—Robert L. Stearns; Dickinson Wright PLLC

(57) ABSTRACT

A method for making a gasket (32) for an internal combustion engine (20) includes forming a generally annual stopper (38) on a metallic gasket body (40) through the process of electrochemical deposition. An electrolytic cell is completed with the gasket body (40) forming a cathode. The stopper (38) is formed with a contoured compression surface (42) by selectively varying the electrical energy delivered to selected electrodes (70) over time. Electrolyte (48) rich with metallic ions is pumped at high speed through the inter-electrode gap. A PC controller (82) switches selected electrodes (70) ON at certain times, for certain durations, which cause metallic ions in the electrolyte (48) to reduce or deposit onto the gasket body (40), which are built in columns or layers into a three-dimensional formation approximating the target surface profile (106) for the compression surface (42). The subject method for building a three-dimensional formation can be applied to work parts other than cylinder head gaskets (32).

6 Claims, 8 Drawing Sheets

U.S. PATENT DOCUMENTS

2004/0188259 A1 9/2004 Wilson et al.
2005/0000818 A1 1/2005 Graham et al.
2005/0061676 A1 3/2005 Wilson et al.
2005/0072686 A1 4/2005 Shaw et al.
2005/0084987 A1 4/2005 Wilson et al.
2006/0049038 A1* 3/2006 Griego et al. ..... 204/228.1

* cited by examiner

FABRICATION OF TOPICAL STOPPER ON MLS GASKET BY ACTIVE MATRIX ELECTROCHEMICAL DEPOSITION

BACKGROUND OF THE INVENTION

1. Field of the Invention

This invention relates generally to a method and apparatus for electrochemical deposition (ECD). More particularly, it relates to an arrayed multi-electrode ECD apparatus and method of creating an infinite variety of topographical contours from a static, generically-shaped anode array and, even more specifically, toward the fabrication of a contoured stopper on an MLS gasket using the ECD process.

2. Related Art

Some manufactured products require extremely thin, high precision contoured formations on a metallic work part. As an example, metallic gaskets such as those used for sealing the compression chambers of an internal combustion engine typically include a topographically contoured stopper to provide a uniform stress distribution, flat contacts, and tight sealing without excessive pre-loaded compression. Also, uniform stress distribution lowers failure rate and prolongs the gasket life. The fabrication of a topographically contoured stopper is extremely challenging by any prior art process. Most commonly, a coining operation is used to produce profiles on the very thin stopper features, which usually range between 60 and 150 micrometers. However, the results of coining tend to be unsatisfactory because excessive deformation and stress are introduced to the profile of the very thin layers.

The gasket stopper example is but one of innumerable industrial applications in which precision-contoured features are required to be produced on a metallic work part. Accordingly, there is a need for an improved manufacturing process with which to form three-dimensional topographical features onto a work part. It would be desirable to implement such a process which does not require rotation or relative movement of any kind between the forming tool and the work part. It is further desirable to develop such a process which is of a generic variety and adapted to produce an infinite variety of contoured profiles through programmable control.

SUMMARY OF THE INVENTION

The invention contemplates a method for building a three-dimensional formation on a work part through the action of electrochemical deposition using a static, generic, multi-segmented electrode array. The method comprises the steps of providing a plurality of anodic electrodes, each having an active end, supporting the plurality of electrodes in an ordered array, electrically insulating each electrode from another, establishing an electrical circuit with each electrode to form individual anodes, providing a cathodic work piece having a work surface to be built upon, supporting the work part with its work surface in opposing spaced relation to the active ends of the electrodes, flowing an electrolyte rich with metallic ions through the space between the work surface and the active ends, selectively varying the electrical energy delivered to specific electrodes to cause metallic ions in the electrolyte to reduce or deposit onto the work surface as a three-dimensional formation, and supporting the active ends of all the electrodes in fixed relation to one another and in fixed relation to the work piece throughout the electrochemical deposition operation.

According to another aspect of the invention, a method for building a three-dimensional formation on a work part through the action of electrochemical deposition using a multi-segmented electrode array comprises the steps of: providing a plurality of anodic electrodes each having an active end, supporting the plurality of electrodes in an ordered array, electrically insulating each electrode from another, establishing an independent electrical circuit with each electrode, providing a cathodic work piece having a work surface to be built upon, supporting the work piece with its work surface in opposing spaced relation to the active ends of the electrodes, flowing an electrolyte rich with metallic ions through the space between the work surface and the active ends, selectively varying the electrical energy delivered to specific electrodes to cause metallic ions in the electrolyte to reduce or deposit onto the work surface as a three-dimensional formation, and masking a portion of the work surface with an electrical insulator to prevent deposition of the metallic ions on select regions of the work surface.

The subject method provides an extremely accurate, non-impact technique for forming topographically contoured formations on a work piece using the process of active matrix electrochemical deposition. The subject process is energy efficient, conservation friendly, and provides extremely accurate formations. The process is readily adaptable to programmed control through use of a computer or other digital process controlling device.

According to yet another aspect of the subject invention, a method for making a gasket of the type for clamped retention between a cylinder head and a block in an internal combustion engine is provided. The method comprises the steps of providing a sheet-like metallic gasket body having a work surface, forming at least one cylinder bore opening in the gasket body, supporting a plurality of electrodes in an ordered array, electrically insulating each electrode from another, establishing an electrical circuit with each electrode to form individual anodes, supporting the gasket body with its work surface in opposing spaced relation to the electrodes, establishing an electrical circuit with the gasket body to form a cathode, flowing an electrolyte rich with metallic ions through the space between the work surface and the electrodes, forming a generally annular stopper about the cylinder bore by creating an electrical potential between a plurality of the electrodes and the gasket body to cause metallic ions in the electrolyte to reduce or deposit onto the work surface, and forming a contoured compression surface on the stopper by selectively varying the electrical energy delivered to the electrodes over time.

The subject method for making a gasket having a topographically contoured stopper provides an economic alternative to the traditional coining process and provides extremely fine quality control. Furthermore, the cost for producing the electrode array tool is substantially lower than the cost to produce a coining tool for this application. By forming a topographical stopper directly upon the gasket body, another advantage is realized through the elimination of laser welding or other attachment process. Furthermore, a substantial reduction in sheet steel consumption can be realized. And, in addition, opportunities are opened to use engineered alloys by enriching the electrolyte with different types of metallic ions.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE PREFERRED EMBODIMENT

Figure 1:
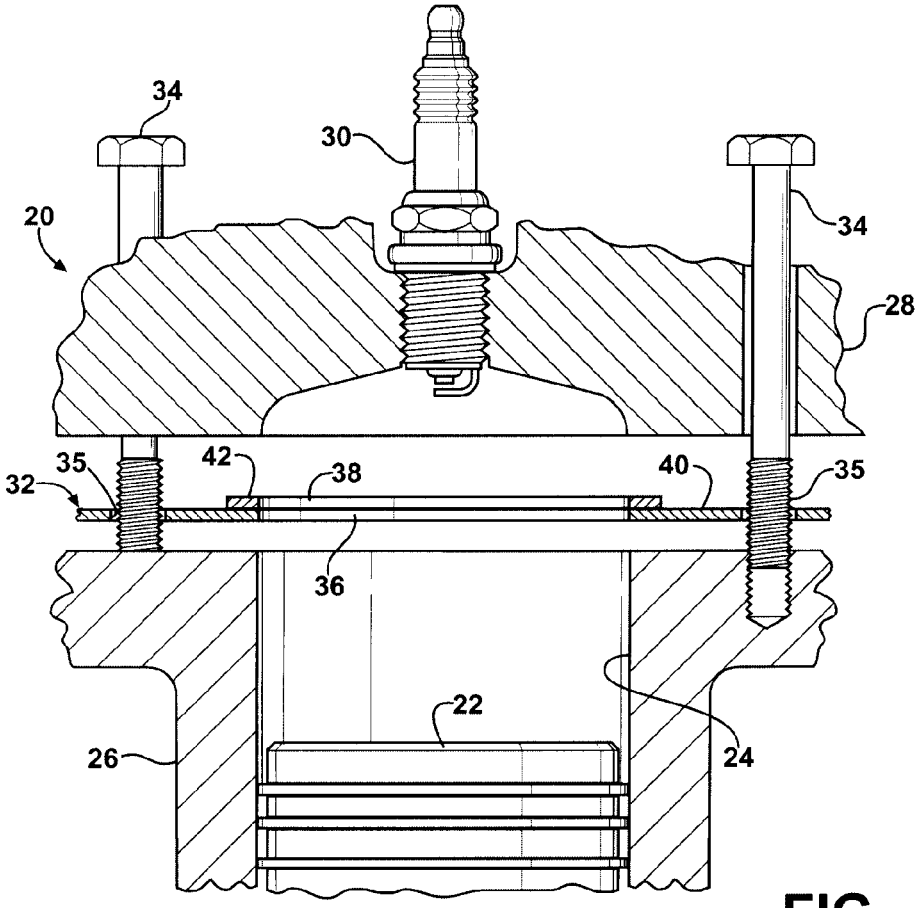
FIG. 1 is a simplified, fragmentary cross-sectional view of an internal combustion engine showing a gasket poised for clamped retention between a cylinder head and a block.

Referring to the figures, wherein like numerals indicate like or corresponding parts throughout the several views, a representative example of an internal combustion engine is generally shown at 20 in FIG. 1. The engine 20 is shown including a piston 22 supported for reciprocating movement inside a cylinder bore 24 formed in an engine block 26. A cylinder head 28 opposes the block 26 and encloses the cylinder bore 24 to form a compression chamber. A spark plug 30 or other ignition device may be associated with the compression chamber to initiate ignition. Of course, compression-ignition engines may be configured differently. A cylinder head gasket, generally indicated at 32, having a sheet-like metallic body 40, is positioned between the cylinder head 28 and the block 26 for perfecting a gas-tight seal therebetween. Bolts 34 or other fastening elements are strategically arranged in spaced locations so as to apply a distributed clamping load. The bolts 34 pass through corresponding holes 35 in the gasket body 40.

Figure 2:
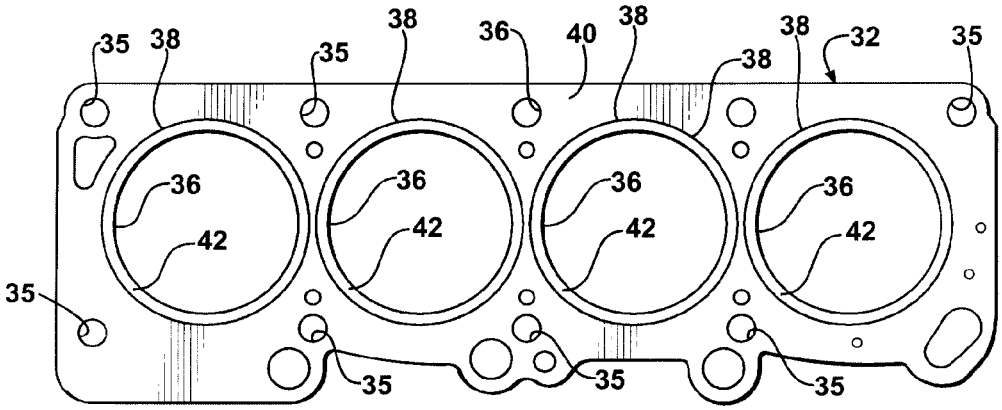
FIG. 2 is a plan view of an exemplary cylinder head gasket.

The exemplary cylinder head gasket 32 depicted in FIG. 2 includes four spaced openings 36 corresponding to the cylinder bores of an associated engine. The number, size, and arrangement of openings 36 will change from one engine application to the next. Typically, a stopper 38 will encircle each opening 36 and represents the thickest portion of the gasket 32. In closely-spaced applications, adjacent stoppers 38 may intersect between interior openings 36. The purpose of the stopper 38 is to concentrate all of the compressive stresses into a well-defined region about the cylinder bore 24, thereby enhancing the sealing effects of the gasket 32 without excessive pre-load compression. The stopper 38 of the subject invention is formed by an electrochemical deposition technique, wherein metallic ions are reduced out of an electrolyte and deposited onto the gasket body 40 in only the desired location and thickness.

Figure 3:
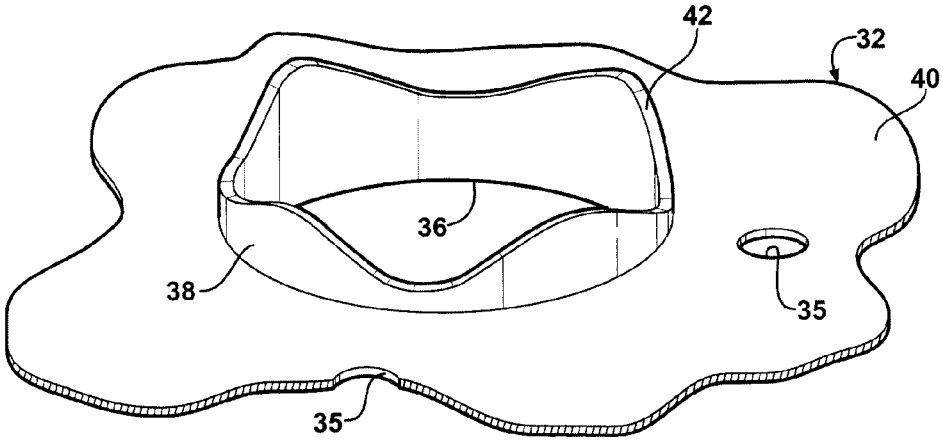
FIG. 3 is a fragmentary perspective view of a gasket depicting its stopper in highly exaggerated dimensions so as to emphasize the contoured profile of its compression surface.
Figure 5:
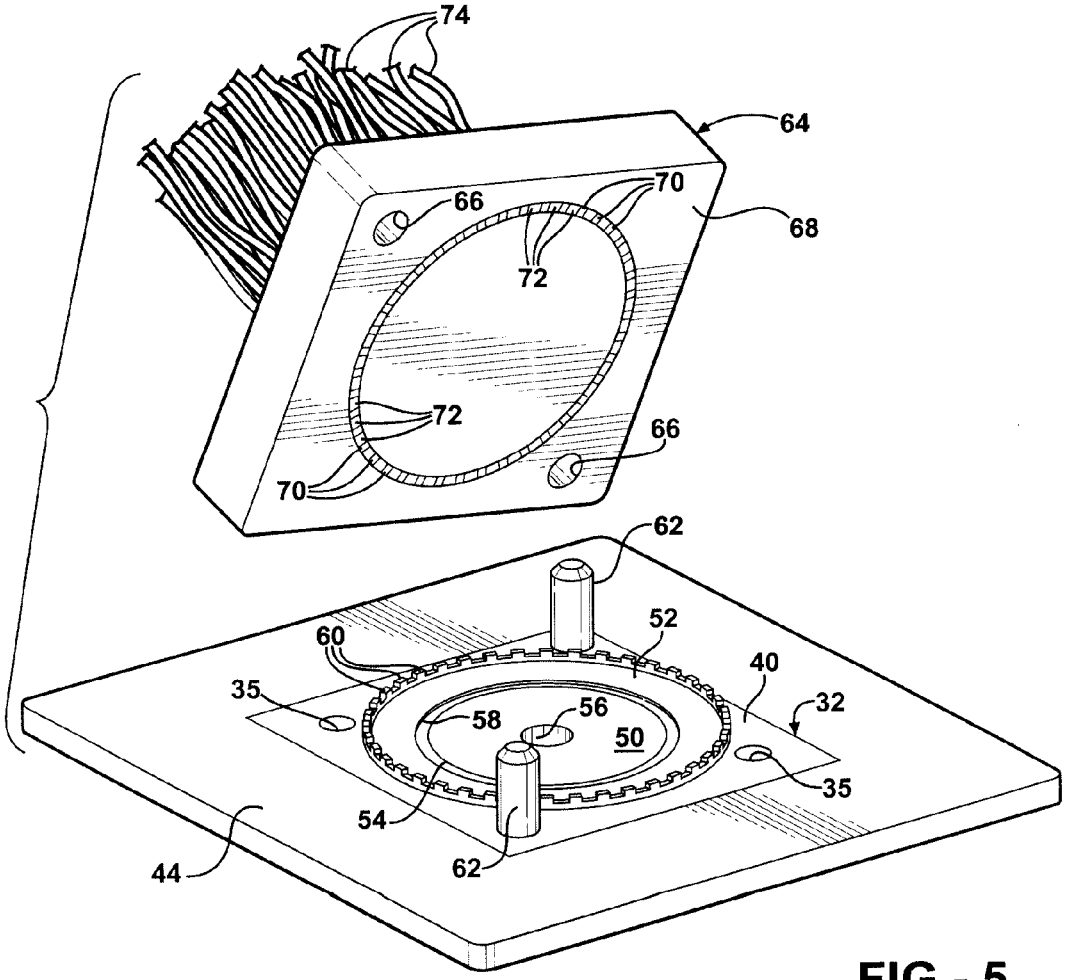
FIG. 5 is a simplified perspective view of an active matrix electrochemical deposition tool according to the subject invention.

Referring now to FIG. 3, a highly exaggerated view of a stopper 38 is depicted in conjunction with a fragment of the gasket body 40. An upper compression surface 42 of the stopper 38 is intentionally contoured to correspond with the relative location and anticipated clamping loads of surrounding bolts 34. Considering such aspects as flex in the cylinder head 28, stretch of the bolts 34, variable thermal expansion around the stopper, and compressibility of the stopper 38, a theoretical contour is formed upon the compression surface 42 so that when the cylinder head 28 is secured in position over the block 26 with the bolts 34 torqued to specification, a substantially even stress distribution is created in the stopper 38. This even stress distribution translates into uniform sealing between the gasket 32 and the respective block 26 and cylinder head 28. While the contours depicted in FIG. 3 are shown excessively exaggerated, in practice the contour variations could not easily be discerned by the unaided eye. Typically, profile height changes on the order of 60-150 micrometers may be all that is required to achieve the desired uniform stress distributions in the stopper 38.

FIGS. 4-7 depict the subject electrochemical deposition apparatus and process used to create the three-dimensional formation which is exemplified herein as a gasket stopper 38. According to the subject process, the metallic gasket body 40 is placed on a platen 44. The platen 44 may be submerged in an electrolyte tank 46 filled with a liquid electrolyte 48. Portions of the body 40 are masked to prevent inadvertent deposition of metallic ions outside of the region designated for the stopper 38. The masks in this case include an internal barrier 50 and an external barrier 52. The internal barrier 50 may, in this example, be generally disk shaped, having an annular outer edge 54 defining the inner boundary of the stopper 38 to be formed. Preferably, the internal barrier 50 is provided with a central aperture 56 through which electrolyte can flow. The external barrier 52 has an annular inner edge 58 which opposes the outer edge 54 of the internal barrier 50. The space between the inner edge 58 and the outer edge 54 exposes an intended region of the gasket body 40 upon which the stopper 38 will be subsequently formed. The external barrier 52 may also include a plurality of upstanding pads 60 of generally uniform height. The pads 60 provide two functions. Firstly, the top of the pads 60 serve as spacers against which the opposing tool part will abut. Secondly, the gaps between the pads 60 allow electrolyte to flow across the inter-electrode area, depending upon the preferred direction of electrolyte flow.

The platen 44 may also include one or more locator pins 62 for aligning the gasket body 40 through bolt holes 35 or some other features. The locator pins 62 also align a multi-segmented electrode array, generally indicated at 64. Locator holes 66 formed in an insulator body 68 of the electrode array 64 receive the locator pins 62. In the preferred embodiment of this invention, the electrode array 64 includes a plurality of regularly spaced, independently isolated electrodes 70 arranged in an annular pattern corresponding to the annular shape of the stopper 38 to be formed on the work surface of the body 40. Thus, the locator pins 62, when registered in the locater holes 66, precisely align the individual electrodes 70 with their respective active ends 72 in opposing relation to the work surface of the gasket body 40 and directly over the channel created between the internal 50 and external 52 barriers where the stopper 38 is to be formed.

Figure 4:
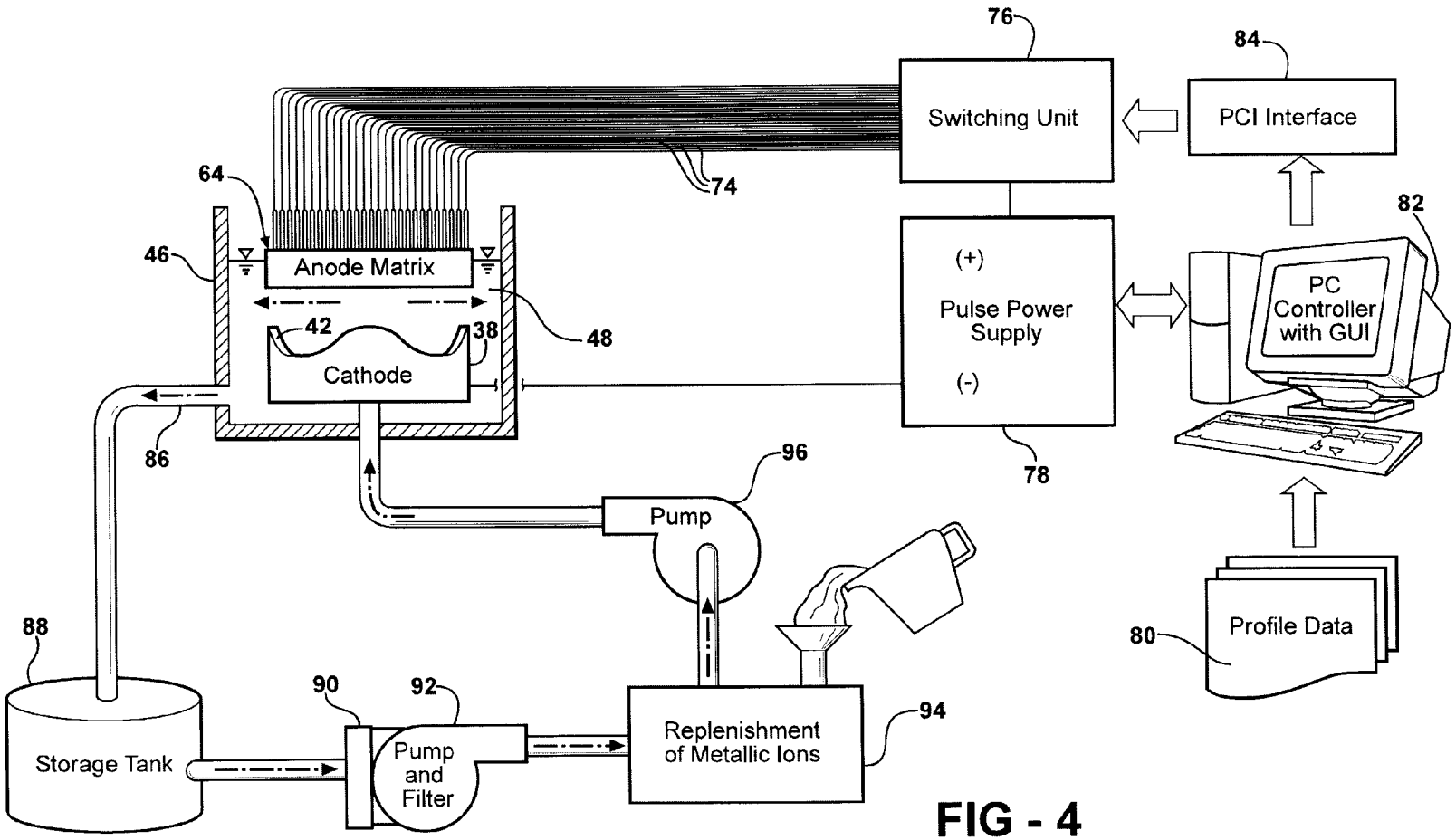
FIG. 4 is a schematic view of a method and apparatus for building a three-dimensional formation on a work piece through programmed control.
Figure 6:
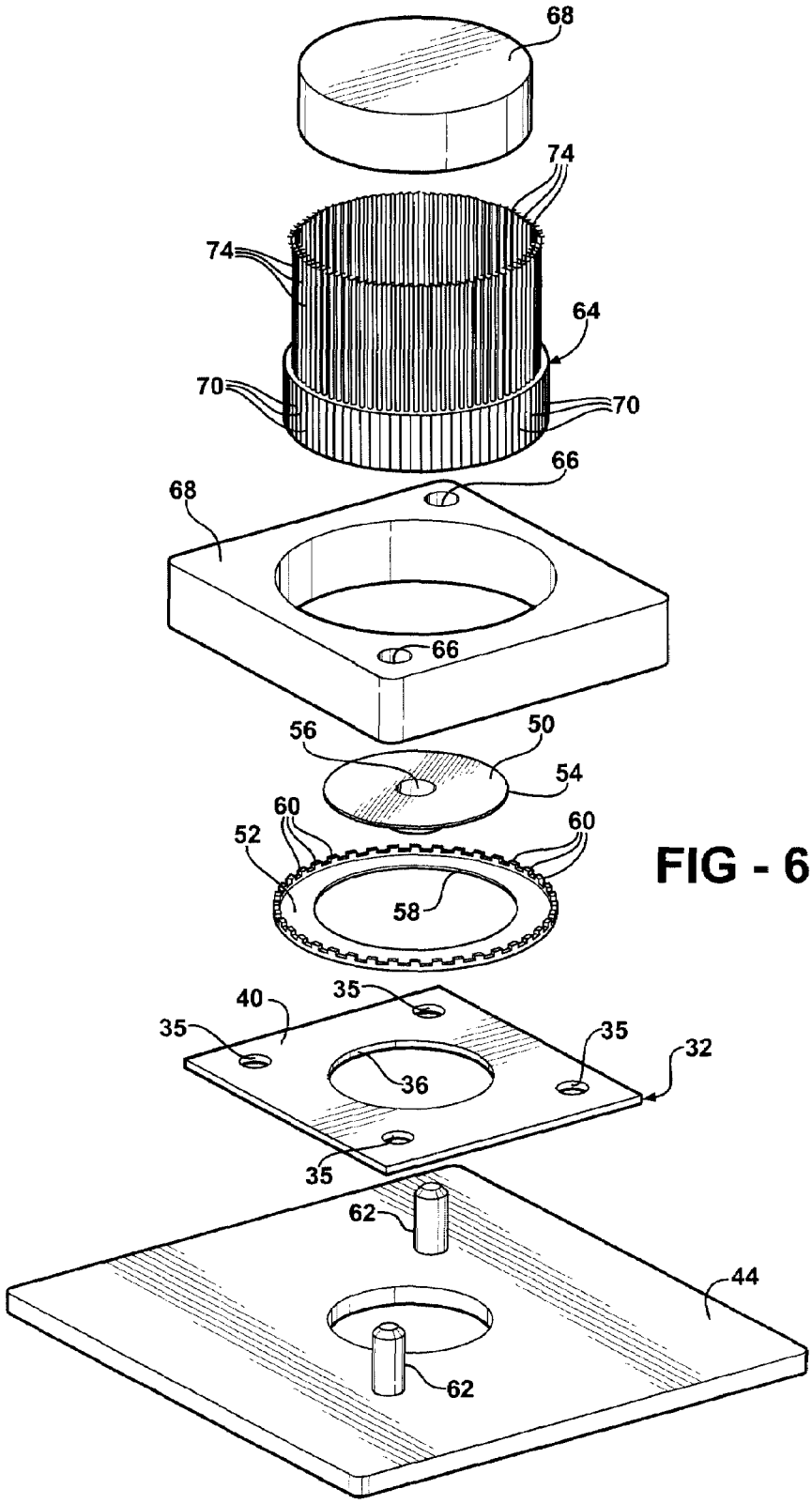
FIG. 6 is an exploded view of the tool as depicted in FIG. 5.
Figure 7:
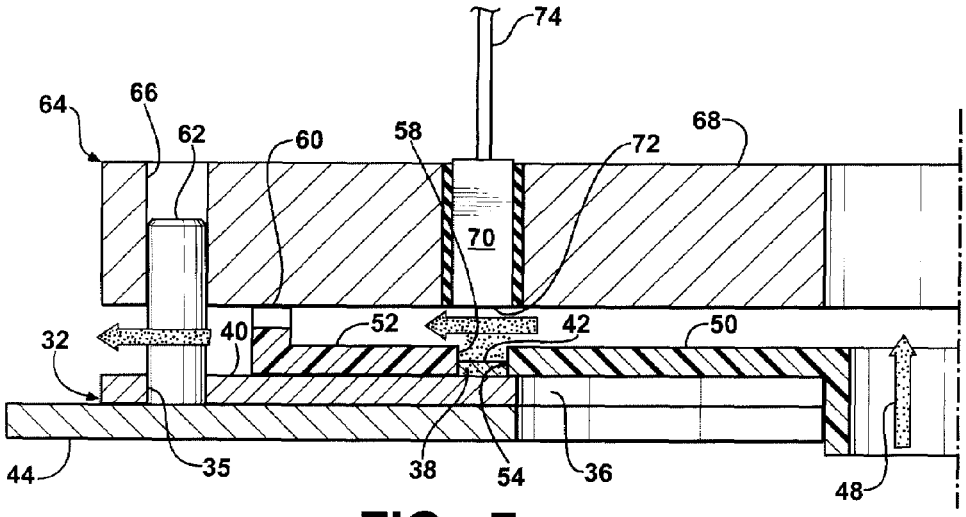
FIG. 7 is an enlarged fragmentary cross-sectional view showing a work part held within the active matrix electrochemical deposition tool and a flow of electrolyte passing through the space between the work piece and the electrode.

Referring now to FIG. 4, a schematic representation of the electrode array 64 is shown partially submerged in liquid electrolyte 48 in the electrolyte tank 46. Each individual electrode 70, or groups of electrodes 70, are connected via a conduction wire 74 to a switching unit 76. The switching unit 76 is, in turn, electrically connected to the positive side of a power supply unit 78. The negative side of the power supply unit 78 is connected directly to the gasket body 40 or the platen 44, which then functions as the cathode portion of an electrolytic cell. The electrodes 70 comprise the anode section of the electrolytic cell. When the power supply 78 is energized, the switching unit 76 completes an electrical circuit to any one or all of the individual electrodes 70. When this happens, an electrical differential is established between the active end 72 of the switched-"ON" electrodes 70 and the conductive metal body 40 of the cylinder head gasket 32. Metallic ions in the liquid electrolyte 48 are influenced under the electrical field to reduce or precipitate out of solution and deposit on the cathode portion of the electrolytic cell. Accordingly, these metallic ions accumulate onto the upper work surface of the gasket body 40 as a three-dimensional formation.

By selectively varying which electrodes 70 are switched ON and OFF over time, contoured profiles of deposited metallic ions can be grown or built on the work surface of the gasket body 40. The specific profile of the stopper's compression surface 42 can be predetermined and input as profile data 80 into a PC controller having a graphic user interface (GUI) 82. The GUI is a software that communicates with the user. It includes not only the monitor, but also, the keyboard, PC hardware, and software. The PC controller 82 functionally controls the pulse power supply 78 and the switching unit 76 via a PCI interface 84 or other interfaces so that the individual electrodes 70 can be energized and de-energized, i.e., switched ON and OFF, at the appropriate times during the electrochemical deposition process.

The power supply 78, together with switching unit 76, generates a temporary electrical field that can be localized in accordance with the amount of local ion deposition required. According to one approach, the amplitude of the local electrical field can be varied or, alternatively, the application time can be varied on the different locales for the generation of the stopper 38 profile. Pulse ECD is taken as the example for detailing the process control because pulse ECD gives fine grain size and allows direct digital control. Pulse ECD applies uniform electrical pulses and varies only the application time for variable stopper 38 height. Through the PCI interface 84, the PC controller 82 controls all the switches so that the stopper 38 profile is fully programmable. There is also the communication between the PC controller 82 and the pulse power supply 78 for pulse control.

Preferably, the liquid electrolyte 48 is recirculated through the tank 46, as best shown in FIG. 4. Here, used electrolyte is drained from the tank 46 via conduit 86. This outflow from the tank 46 is directed to a storage tank 88 for buffering the electrolyte temperature and its concentration. The electrolyte 48 is then passed through a filter 90, under the influence of a pump 92. From there, the electrolyte 48 is directed to a replenishment unit 94 for ion replenishment and adjustment. Ion replenishment is required because, during the electrochemical deposition process, metallic ions in the electrolyte are consumed. If the electrodes 70 are insoluble, the consumed ions can be added without changing the electrolyte. There are a number of ways to manufacture metallic ions for adding to the replenishment unit 94. For example, a metal oxide can be introduced to react with a corresponding acid and thereby produce water and metal salt in a separate tank. Alternatively, a membrane can be applied to separate two electrolytic cells to produce the desired salt solution without introducing irrelevant ions. Or, an additional anode could be introduced having a large, soluble reaction surface, such as a large sheet or comb structure.

In the replenishment unit 94, the concentration of metallic ions, together with the pH and other ions, are monitored. Consumable chemicals and other necessary treatments are added accordingly. Furthermore, impurities can be extracted in this unit 94. The treated, replenished electrolyte 48 is then pumped via pump 96 back into the electrolyte tank 46. In the arrangement depicted in FIG. 4, pump 96 routes the electrolyte into the aperture 56 passing through the internal barrier 50. Of course, multiple points of entry into the electrolyte tank 46 may be indicated and depend upon the configuration of the particular application. In this example, the electrolyte 48 emerges from the aperture 56 into the interstitial space between the gasket body 40 and the electrode array 64. The flow of electrolyte 48 spreads radially outwardly through the inter-electrode gap at a desired pressure and flow rate, exiting between the spacer pads 60. A reversed flow direction is possible, as well as other flow strategies. In the preferred embodiment, the inter-electrode gap, i.e., the space between the gasket body 40 and the active ends 72 of the electrodes 70, is in the range of 0.4-3.0 mm wide. In order to achieve a high deposition rate, a high-speed electrolyte convection is applied. The electrolyte flow rate is set at 0.5-4.0 m/s, which is substantially higher than the convection speeds at which prior art electrochemical deposition processes are conducted.

Metallic ions in the electrolyte flow 48 immediately below the electrodes 70 switched ON will go through a reduction and deposit on the gasket surface, i.e., the work surface, inside the groove between the internal 50 and external 52 barriers. The reduction does not happen unless the immediately adjacent anode section, i.e., electrode 70, is turned ON. This is the mechanism used to localize the deposition of metallic particles on the body 40 of the gasket 32. On the anode, i.e., the electrode 70, oxidation generates oxygen gas and/or metallic ions. In the case of an insoluble anode, such as one made from titanium or other electrolysis-resistant but conductive material, only oxygen gas is generated and the metallic ions reduced out of the electrolyte 48 must be replenished in unit 94.

Figure 8:
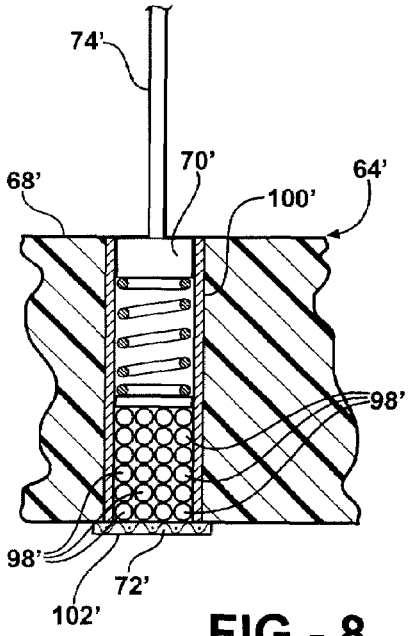
FIG. 8 is an enlarged cross-sectional view of an alternative embodiment of the electrode.
Figure 9:
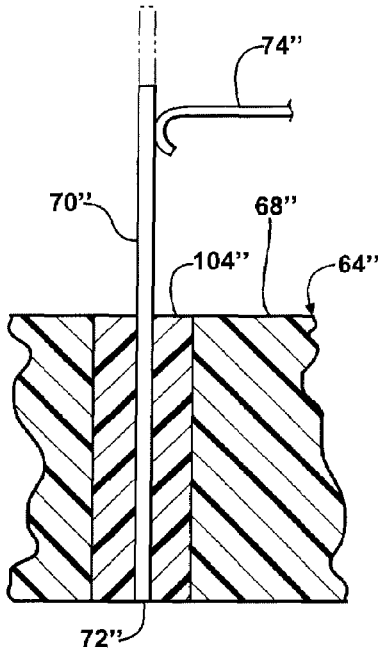
FIG. 9 is an enlarged cross-sectional view of a second alternative electrode design.

FIGS. 8 and 9 depict alternative approaches in which the electrodes are soluble and composed of a material similar or identical to the metallic ions contained in the electrolyte 48. Thus, as the metallic ions reduce out of the liquid electrolyte 48, they are replenished immediately through the dissolving action of the electrodes. Specifically, in FIG. 8, where prime designations are used to distinguish the various components and features from the preferred embodiment, the electrode wire 74' joins to the electrode 70', which is composed of a plurality of metal particles 98' contained inside an anode box 100'. A front, insoluble metal screen 102' prevents the metal particles 98' from falling out of the box 100', but permits contact with the electrolyte. The particles 98' are oxidized into metallic ions through the insoluble screen 102'. Under the force of spring 71', the particles 98' in the back row are pushed into the front row after the ones in the front are dissolved. The box 100' will be filled with new metal particles 98' when the box 100' is almost empty. Therefore, the active end 72' of the electrode 70' always has a constant position, even though the anodic material is soluble.

FIG. 9 represents another soluble electrode approach. Double prime designations are used here to distinguish the various features from that of the preferred embodiment. In FIG. 9, the soluble anode, or electrode 70", comprises an elongated stick-like wire. The electrode 70" may be held in a guide bushing 104". In this case, the elongated electrode 70"feeds as its front active end 72" is eroded away during the oxidation. An approximately constant anode position, i.e., active end 72" position, can be maintained with intermittent feeding. The cross-section of the electrode 70" can be circular or square or other configuration to fill the desired space of the electrode. The small retreat from the initial front position can be compensated by wire feeding, as well as erosion increment. The erosion increment is realized through the increase of voltage and/or time, which is controlled by the PC controller. The feed wire 74" is schematically represented with a sliding contact interface to the electrode 70" so as to maintain electrical conductivity while the electrode 70" is advanced to compensate for erosion. Of course, other techniques and arrangements are possible in the case of soluble electrodes.

Regardless of whether ion replenishment is accomplished through the replenishment unit 94 or via soluble electrodes 70', 70", the deposited materials may include nickel, iron, and various alloys capable of electrochemically depositing on the work surface. The mechanical properties of the deposited formation can be improved through the use of engineered alloys.

Figure 10:
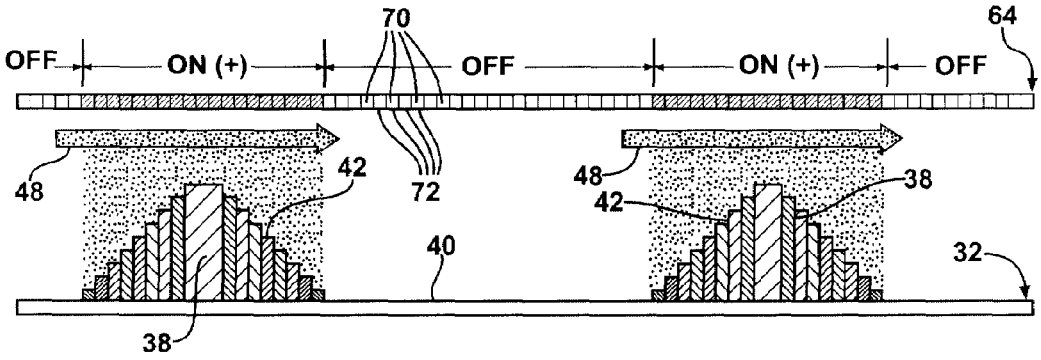
FIG. 10 is an illustrative view depicting, in exaggerated form, the formation of two spaced topographical formations on a work surface, with metallic ions reducing out of the electrolyte under the influence of electrical field.
Figure 11:
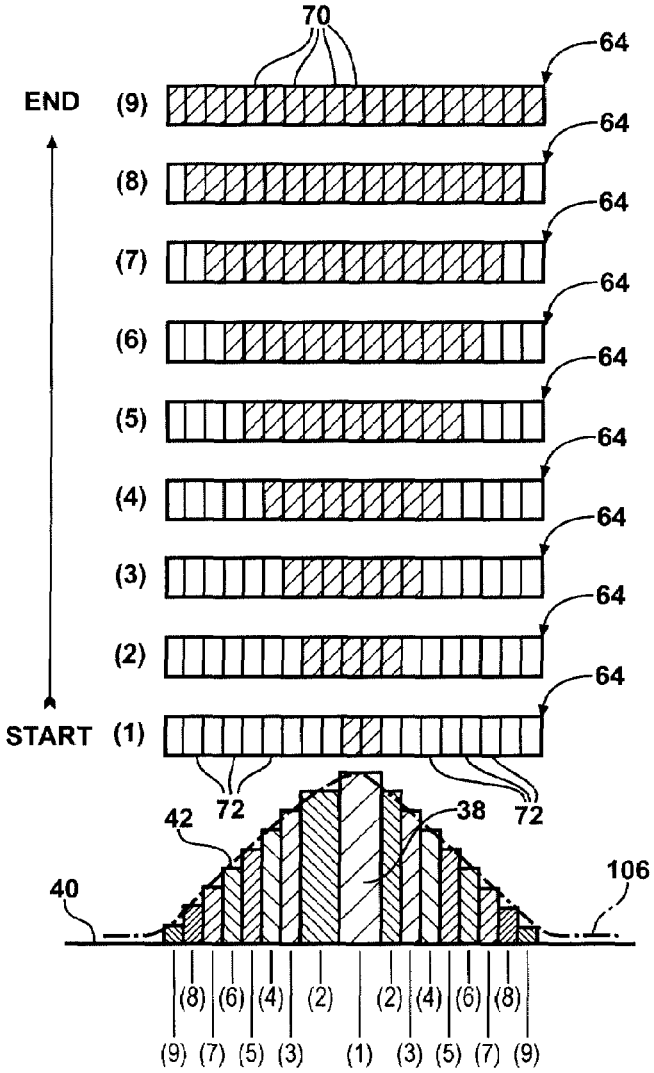
FIG. 11 is an illustrative view depicting the time sequence over which selective electrodes are energized to form the topographical contour through the action of electrochemical deposition.

FIGS. 10-14 address more specifically the digital processes used to produce any contoured topography, but are presented in the continued exemplary context of a gasket stopper 38. Referring specifically now to FIGS. 10 and 11, a columnated process is depicted. The columnated process may be desired due to its tendency to produce less surface divisions on the compression surface 42. In this case, a program is set through the PC controller 82 to control the switching patterns carried out within switching unit 76. A program runs according to the data file 80 that corresponds to the target profile geometry and other process specifications. In these figures, electrodes 70 are depicted schematically as small blocks. Unshaded blocks represent electrodes switched "OFF." Shaded blocks, on the other hand, represent electrodes 70 switched "ON," thereby delivering positive electrical potential from the power supply 78.

FIG. 11 represents a switching pattern sequence, over nine time intervals comprising one or multiple pulses, which form a contoured profile on the compression surface 42 of the stopper 38. The resulting stair-step profile generally approximates a theoretical or target surface profile 106. The target profile 106 is divided into uniform sections corresponding to the width of the electrodes 70. A switch pattern and erosion time is then calculated from the topography design for each programmed section. FIG. 11 exemplifies the deposition process, including multiple steps. At the start of the electrochemical deposition process, only two adjacent electrodes 70 are switched ON, forming the beginning of a first column (1) directly thereunder. At a second time interval (2), five electrodes 70 are switched ON, thus building new columns and building further upon the previous column. The sequence progresses with deposition durations for the different columns being determined from the program first input through the profile data 80. The deposition duration and the switching pattern change together to generate a three-dimensional profile on the work surface. In the case of the exemplary stopper 38, the electrodes 70 are arranged in a single annular row, and the three-dimensional pattern follows the annular array. Those of skill in the art will appreciate that the electrodes 70 can be arranged in a matrix configuration so that any three-dimensional formation can be accomplished through a static, generic, multi-segmented electrode array 64.

Figure 12:
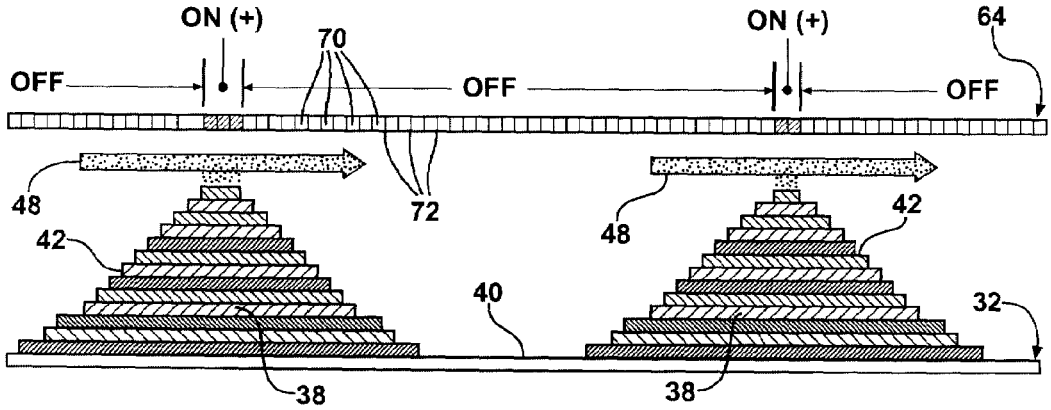
FIG. 12 is an illustrative view as in FIG. 10, but depicting an alternative energization sequence by which the contour profile is generated in layers.
Figure 13:
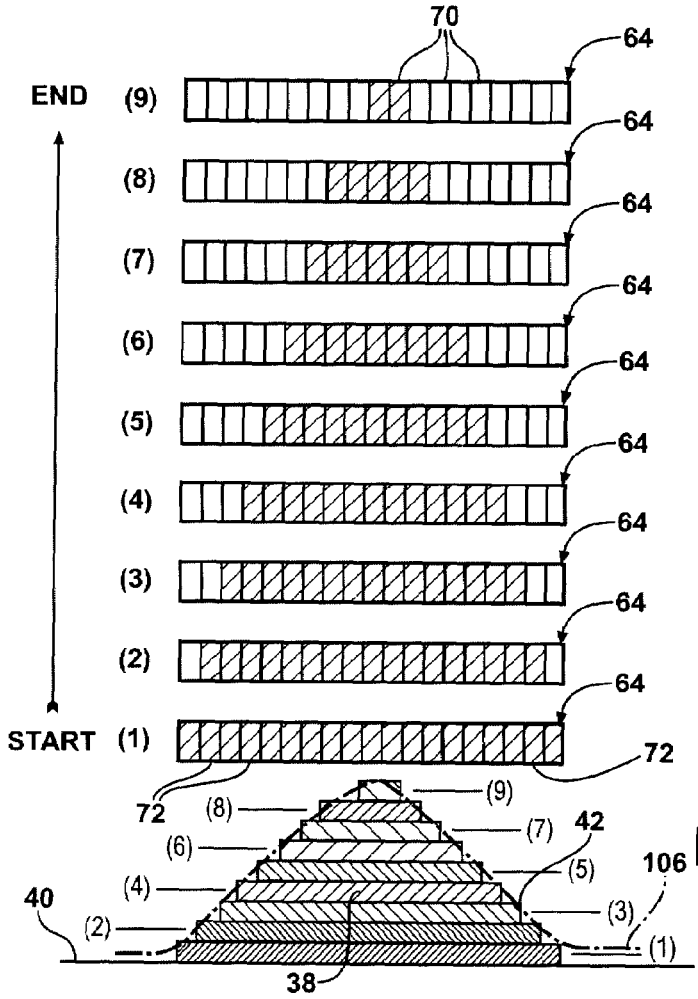
FIG. 13 is a time sequence view as in FIG. 11, but depicting the electrode switching sequence of FIG. 12.

FIGS. 12 and 13 represent an alternative deposition strategy, with a switching pattern logic designed to establish layers instead of columns. In this case, layers (1)-(9) of uniform or variable thickness are deposited in a switching pattern, which is generally opposite that depicted in FIGS. 10 and 11. A similar result is obtained, however the widest base layer (1) is laid down first, and the narrowest top layer (9) is laid down last. The width of different regions shrinks as the PC controller 82 turns OFF more and more switches on line according to the profile design. After the last layer (9) is deposited, the PC controller 82 turns off all the switches and shuts down the power supply 78.

Figure 14:
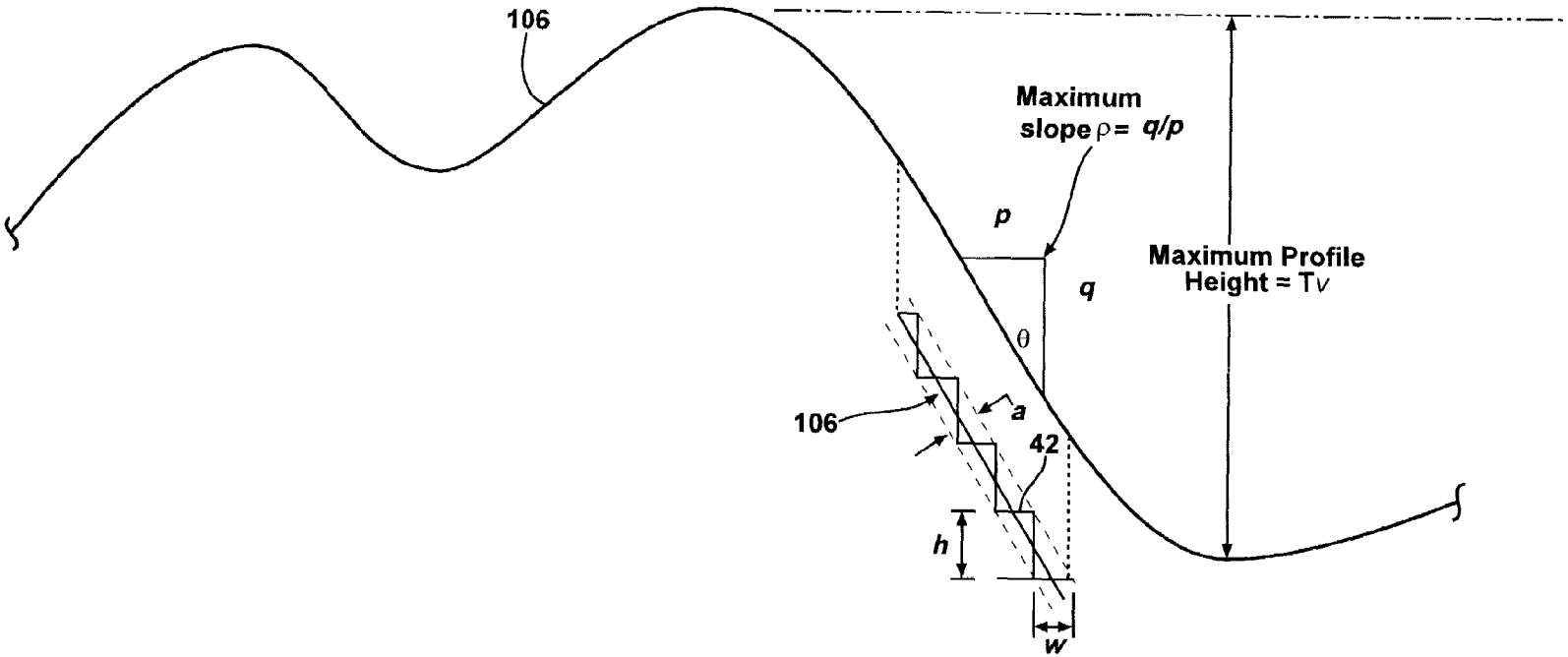
FIG. 14 is an arbitrary target profile to be formed by electrochemical deposition, with dimensional values identified with variable symbols to describe the digitizing rules for the subject invention.

Referring now to FIG. 14, the rules that basically determine the division of the cathode matrix, i.e., dimensional qualities of the electrodes 70, as well as the layer thickness according to given parameters, are depicted. FIG. 14 makes use of the following variable parameters:

Profile tolerance—$\alpha$;

Cycle time—T;

Maximum profile slope—$\rho$;

Erosion rate—$\upsilon$;

Total number of deposit layers (i.e. deposition intervals)—n;

Anode section width—w; and

Layer thickness—h.

Using these parameters as depicted also in FIG. 14, the following criteria of worst case scenario must be satisfied:

$$(1).\ w = \frac{a}{\cos\theta} = a \cdot \frac{\sqrt{q^2 + p^2}}{q} = a \cdot \sqrt{1 + (p/q)^2} = a \cdot \sqrt{1 + \rho^{-2}}$$

$$(2).\ h = \frac{a}{\sin\theta} = a \cdot \frac{\sqrt{p^2 + q^2}}{p} = a \cdot \sqrt{1 + (q/p)^2} = a \cdot \sqrt{1 + \rho^2}$$

$$(3).\ h = \nu \cdot T / n$$

The given parameters include the requirements of profile accuracy ($\alpha$), changing rate, and process rate. Three conditions must be met for minimum requirements. Violation of the first condition (maximum width of the electrodes 70) results in an excessively large anode section that cannot meet the tolerance where the profile is steepest. According to this first condition, no division is needed if the slope is equal to zero for a horizontal line. This is because the maximum division width is infinite for zero slope. On the other hand, the maximum division width has to be as small as the tolerance zone ($\alpha$) if the curve meets a vertical line at certain locations. The violation of the second condition (maximum layer thickness) also results in violation of the given tolerance ($\alpha$). Violation of the third condition (minimum layer thickness) results in a process that is too slow to meet the requirement of overall process cycle time. These three conditions determine the worst case scenario. Safety coefficients are given to determine the practical division width and layer thickness. The maximum division width (w) will become the key specification for the anode matrix. Too many divisions increases the manufacturing cost of the arrayed anode. On the other hand, divisions coarser than the maximum width w cannot satisfy the accuracy specification. Given the layer thickness (h) and the profile design, a data file 80 can be produced to control the digitized process. The data file 80 will contain the information for each layer, including the layer number, deposition time, and the electrode 70 switching pattern. The deposition time determines the layer thickness. The switching pattern depends on the profile range at the certain amplitude.

After the anode and profile are properly divided into uniform sections, it is next to determine the switch pattern and erosion time from the topography design for each program section. These are accomplished in a similar fashion, varying somewhat whether the columnated process (FIGS. 10-11) or layered process (FIGS. 12-13) is used.

While the preferred embodiment of the subject invention is explained through the process of making a gasket 32 for an internal combustion engine 20, those of skill in the art will appreciate that the multi-segmented electrode array 64, operated through the programmable switching unit 76 and pulse power supply 78, can be used to create an infinite variety of three dimensional formations on a work surface. By altering the profile data 80 input into the PC controller 82, and by expanding the size and resolution of the anode matrix 64, nearly any three-dimensional shape can be achieved, provided the preceding criteria are met. Accordingly, the subject method for building a three-dimensional formation on a work piece through the action of electrochemical deposition using a static, generic, multi-segmented electrode array can be used in any field for any application and is not limited to the manufacture of stoppers 38 on cylinder head gaskets 32.

Obviously, many modifications and variations of the present invention are possible in light of the above teachings. It is, therefore, to be understood that within the scope of the appended claims, the invention may be practiced otherwise than as specifically described.

What is claimed is:

1. A method for making a gasket of the type for clamped retention between a cylinder head and a block in an internal combustion engine, said method comprising the steps of:

providing a sheet-like metallic gasket body having a work surface;

forming at least one cylinder bore opening in the gasket body;

supporting a plurality of electrodes in an ordered array;

electrically insulating each electrode from another;

establishing an electrically circuit with each electrode to form individual anodes;

supporting the gasket body with its work surface in opposing spaced relation to the electrodes;

establishing an electrical circuit with the gasket body to form a cathode;

flowing an electrolyte rich with metallic ions through the space between the work surface and the electrodes;

forming a generally annular stopper about the cylinder bore by creating an electrical potential between a plurality of the electrodes and the gasket body to cause metallic ions in the electrolyte to reduce or deposit onto the work surface; and forming a contoured compression surface on the stopper by selectively varying the electrical energy delivered to the electrodes over time.

2. The method of claim 1, further including the step of making a portion of the work surface with an electrical insulator to prevent deposition of the metallic ions on select regions of work surface.

3. The method of claim 1, wherein said step of flowing an electrolyte includes maintaining an electrolyte flow rate of between 0.5 and 4 meters per second.

4. The method of claim 1, further including the step of supporting the electrodes in fixed relation to one another and in fixed relation to the gasket body throughout said step of forming a generally annular stopper.

5. The method of claim 1, wherein said step of selectively varying the electrical energy includes varying the amplitude of the local energy field.

6. The method of claim 1, wherein said step of selectively varying the electrical energy includes varying the duration of the local energy field.

* * * * *

UNITED STATES PATENT AND TRADEMARK OFFICE

CERTIFICATE OF CORRECTION

PATENT NO. : 7,655,126 B2
APPLICATION NO. : 11/277544
DATED : February 2, 2010
INVENTOR(S) : Yuefeng Luo It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 982 days.

Signed and Sealed this

Twenty-third Day of November, 2010

David J. Kappos

David J. Kappos
*Director of the United States Patent and Trademark Office*